US006719669B1

(12) United States Patent
Wang et al.

(10) Patent No.: US 6,719,669 B1
(45) Date of Patent: Apr. 13, 2004

(54) DISPLACEMENT DETECTOR OF A SHOCK ABSORPTION UNIT FOR A TREADMILL

(76) Inventors: Leao Wang, No.1, Lane 233, Sec.2, Charng Long Rd., Taiping (TW), 411; Peter Wu, No.1, Lane 233, Sec.2, Charng Long Rd., Taiping (TW), 411

( * ) Notice: Subject to any disclaimer, the term of this patent is extended or adjusted under 35 U.S.C. 154(b) by 0 days.

(21) Appl. No.: 10/410,815

(22) Filed: Apr. 11, 2003

(51) Int. Cl.[7] ..... A63B 22/00
(52) U.S. Cl. ..... 482/54
(58) Field of Search ..... 482/51, 54

(56) References Cited

U.S. PATENT DOCUMENTS 5,993,358 A * 11/1999 Gureghian et al. ..... 482/54
6,193,634 B1 * 2/2001 Hurt ..... 482/54
6,254,515 B1 * 7/2001 Carman et al. ..... 482/54

* cited by examiner

*Primary Examiner*—Stephen R. Crow
(74) *Attorney, Agent, or Firm*—Kuo-Hsiung Chiu

(57) ABSTRACT

A treadmill having two handgrip frames, a base frame and a deck frame includes a displacement detector of a shock absorption unit. A cantilever has one end pivotably connected to the lower portion of each of the handgrip frames and the other end pivotably connected to the deck frame. A displacement detector and an adjustable cushioning apparatus with a driving motor are interposed between each connecting arm of the handgrip frame and each cantilever for adjusting the cushioning force. The displacement detector having a cable, a guide roller, a large gear, a small gear and an optical disk is installed at bottom end of the adjustable cushioning apparatus. The optical disk and the small gear are received on a shaft. An optical detector is mounted near one side of the optical disk. The cable with one end fixed at the connecting arm of the handgrip frame extends around the guide roller and the large gear and is secured to the other end to the base frame.

3 Claims, 5 Drawing Sheets

DISPLACEMENT DETECTOR OF A SHOCK ABSORPTION UNIT FOR A TREADMILL

BACKGROUND OF THE INVENTION

1. Field of the Invention

The invention relates to a displacement detector of a shock absorption unit for a treadmill, and more particularly, to a device utilizing optical detection technique to accurately measure the displacement amount of the shock absorption unit when a force is applied onto a platform of the treadmill. Accordingly, a corresponding cushioning force of the shock absorption unit can be precisely controlled.

2. Description of the Related Art

In general, the treadmill is provided with cushioning apparatuses at suitable places for achieving a proper cushioning effect and enhancing the comfort of the operator during a workout session. Meanwhile, a protection mechanism has been developed for preventing both feet of the operator from being injured due to the too large reactive force of the platform of the treadmill. It will be particularly beneficial to the operator if hydraulic or pneumatic cylinders are used to provide more excellent cushioning effect. A few prior arts such as U.S. Pat. Nos. 4,591,147, 5,184,988, 4,974,831, 4,984,810, 5,072,928, 5,372,559, etc. have disclosed the application of hydraulic or pneumatic cylinders to the treadmill.

Although the above-mentioned prior arts have advantages of more excellent protection effect and greater comfort, they all don't have any automatic mechanism for adjusting the cushioning force by operators themselves to meet their own different requirements. In brief, an operator with heavier weight would feel that the cushioning force is too slight while an operator with lighter weight could feel that it is too strong if the cushioning force is fixed at a certain extent. Besides, different operators are their own subjective feeling about the cushioning strength no matter how strong or light the cushioning force is. In addition, some operators have special rehabilitation requirements thereto. Accordingly, the prior arts are required for improvement.

SUMMARY OF THE INVENTION

It is a primary object of the present invention to remove the above-mentioned drawbacks and to provide a shock absorption structure for a treadmill that employs hydraulic or pneumatic cylinders as shock absorption source. The cushioning apparatus is adjustable. Meanwhile, the present invention utilizes optical detection technique to accurately measure the displacement amount of the shock absorption unit when an operator stands on a platform of the treadmill. Accordingly, a corresponding cushioning force of the shock absorption unit can be precisely controlled.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

First of all, the invention is a continuation-in-part of U.S. patent application Ser. No. 10/351,141 with the title of "SHOCK ABSORPTION STRUCTURE FOR A TREADMILL".

Figure 1:
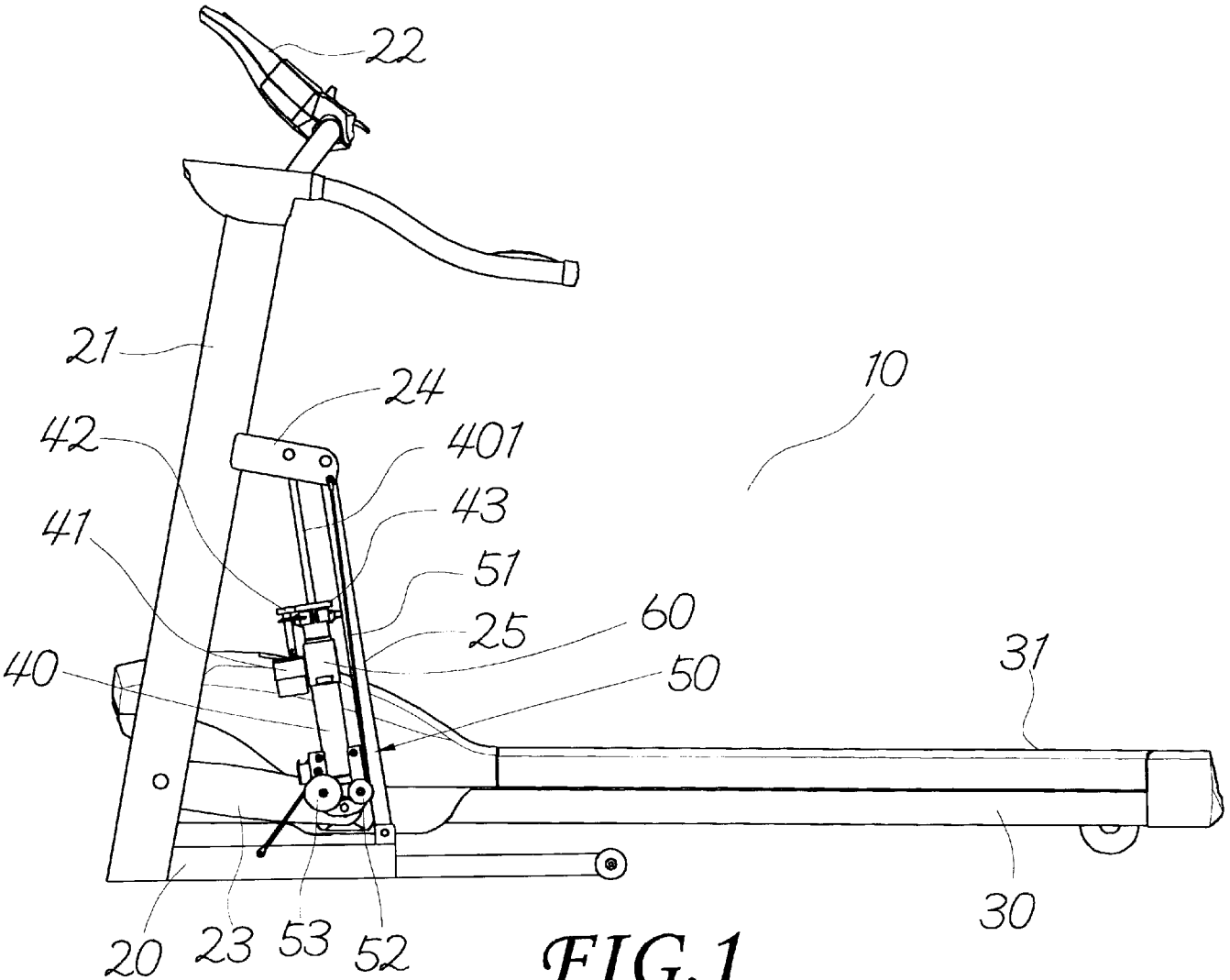
FIG. 1 is a schematic drawing of a preferred embodiment of the invention.
Figure 2:
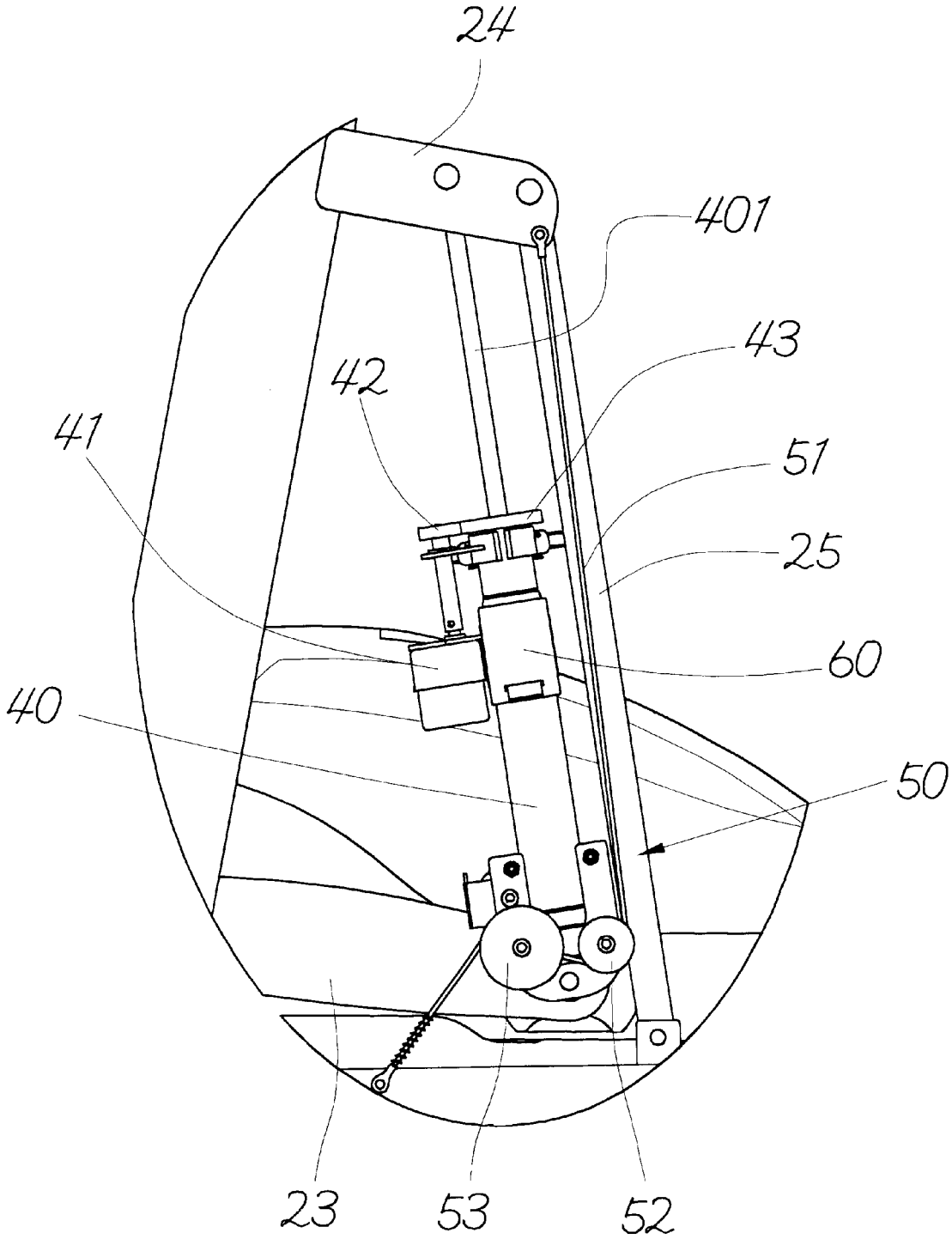
FIG. 2 is an enlarged partial view of an adjustable cushioning apparatus from FIG. 1, showing the installation position of the displacement detector in accordance with the invention.

Referring to FIGS. 1 and 2, a preferred embodiment of the invention is shown. The treadmill 10 includes a base frame 20 and a deck frame 30. A handgrip frame 21 extends upwardly from both sides at front end of the base frame 20 with an electronic control panel 22 mounted thereon. In addition, the deck frame 30 has a running belt 31 movably mounted thereon so that the operator can stand thereon to take the walking, jogging or running exercise.

A cantilever 23 has one end pivotably connected to the lower portion of each of the handgrip frames 21 and the other end pivotably connected to the deck frame 30. A displacement detector 50 and an adjustable cushioning apparatus 40 with a driving motor 41 are interposed between each connecting arm 24 of the handgrip frame 21 and each cantilever 23 for adjusting the cushioning force in accordance with different forces acting on the deck frame 30.

In order to maintain the structural strength of the treadmill 10 and to prevent the adjustable cushioning apparatus 40 from being overloaded, an auxiliary supporting rod 25 is interposed between the connecting arm 24 and the base frame 20.

Figure 3:
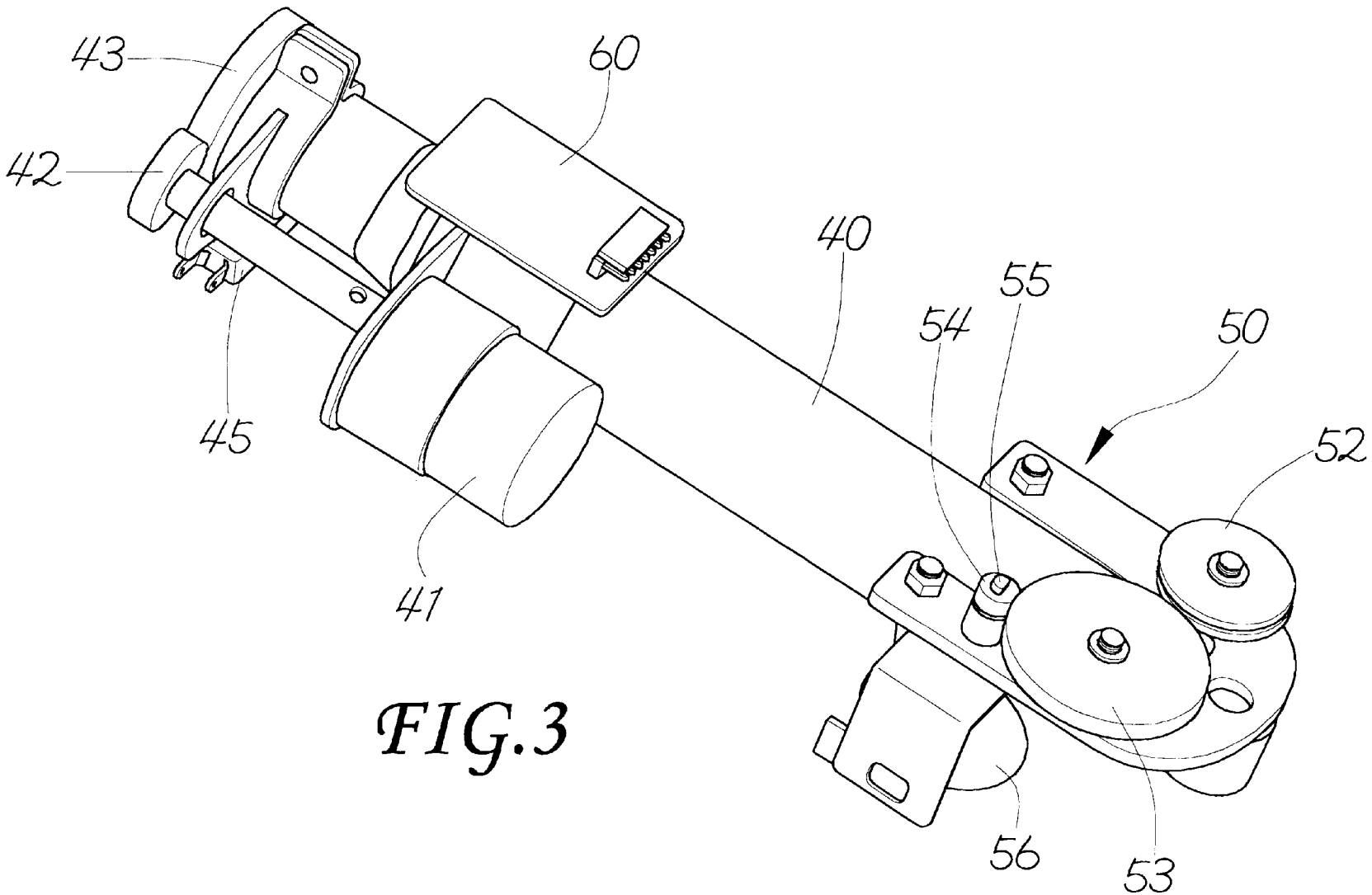
FIG. 3 is a perspective view of the adjustable shock absorption unit and the displacement detector.
Figure 4:
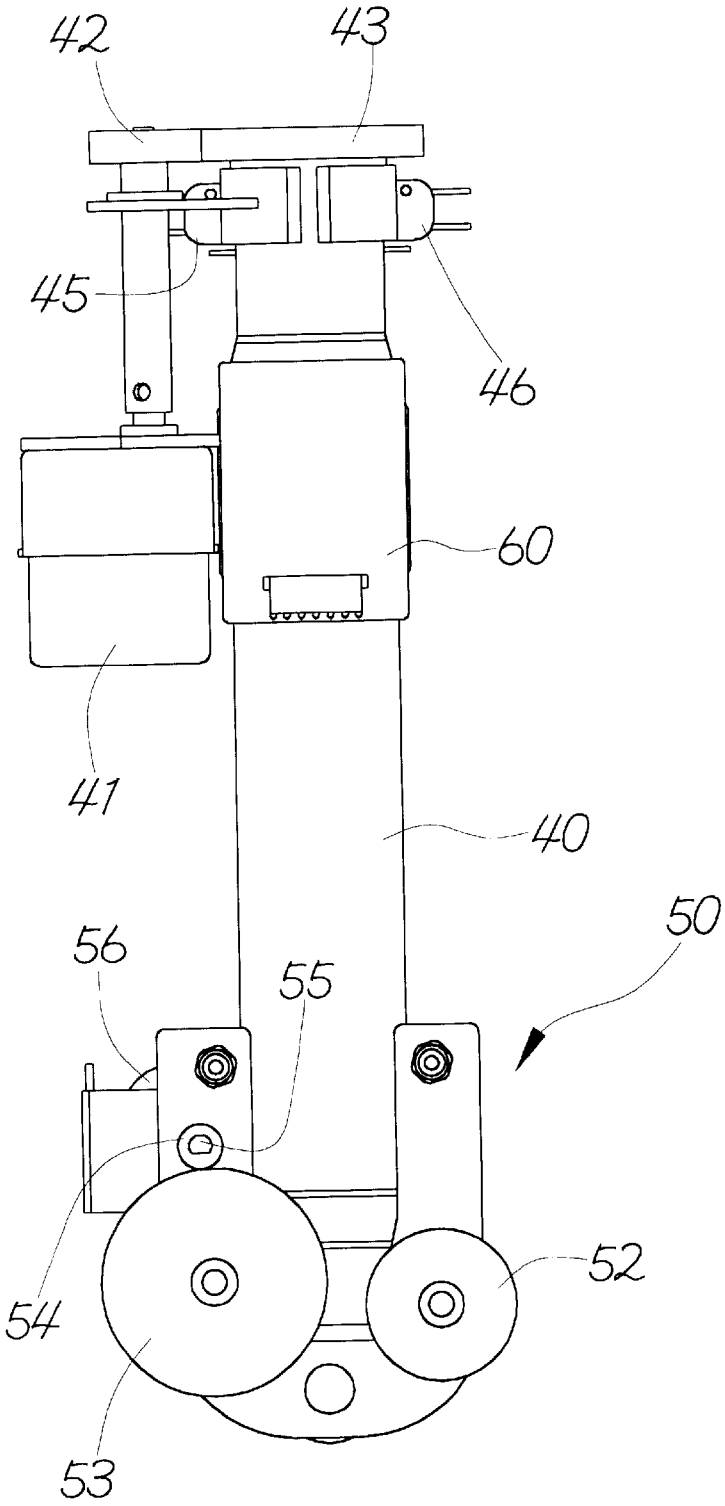
FIG. 4 is a plan view of the adjustable shock absorption unit and the displacement detector.
Figure 5:
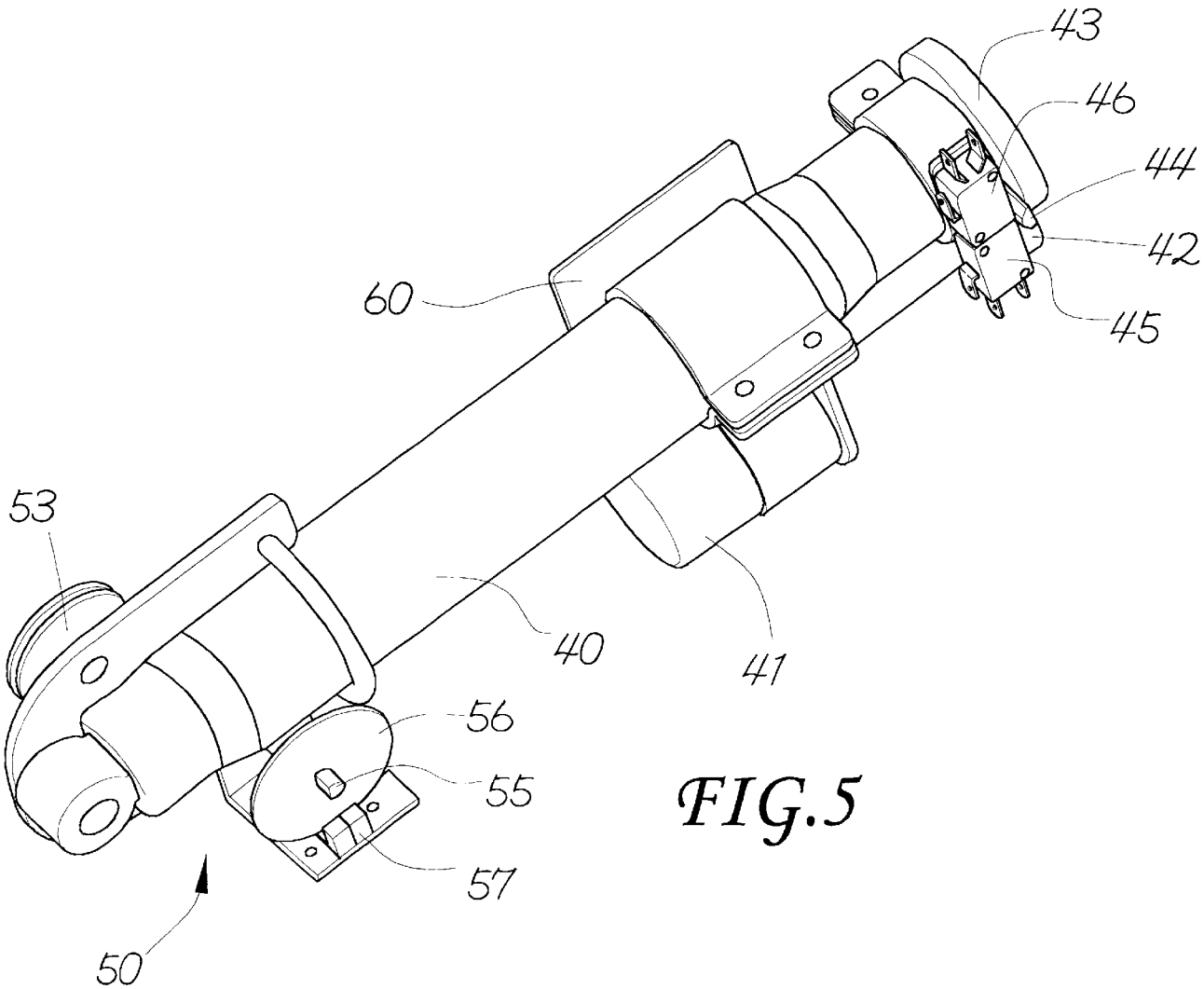
FIG. 5 is another perspective view of the adjustable shock absorption unit and the displacement detector.

Regarding the adjustable cushioning apparatus 40, as shown in FIGS. 2, 3 and 5, the driving motor 41 brings an adjustment gear 43 in rotation through a motor shaft gear 42. The rotation of the adjustment gear 43 enables the adjustment of the cushioning force provided by the adjustable cushioning apparatus 40. In order to achieve an effective restriction of the adjusting travel caused by the driving motor 41, a coupling control element 44 is disposed on the adjustment gear 43. The control element 44 is movable with the adjustment gear 43. When the control element 44 contacts one of micro-switches 45, 46, the driving motor 41 is automatically shut down.

Furthermore, referring to FIGS. 2 through 5, the displacement detector 50 having a cable 51, a guide roller 52, a large gear 53, a small gear 54 and an optical disk 56 is installed at bottom end of the adjustable cushioning apparatus 40. The optical disk 56 and the small gear 54 are received on a shaft 55. An optical detector 57 is mounted near one side of the optical disk 56. The cable 51 with one end fixed at the connecting arm 24 of the handgrip frame 21 extends around the guide roller 52 and the large gear 53 and is secured to the other end to the base frame 20.

Being loaded by weight of an operator, a shaft 401 of the adjustable cushioning apparatus 40 is moved. Thereafter, the large gear 53 is brought into rotation by the movement of the cable 51 so that the small gear 54 meshed with the large gear 53 is also rotated. Therefore, the optical disk 56 in coaxial arrangement with the small gear 54 is rotated as well. Accordingly, the optical detector 57 can determine the displacement amount of the adjustable cushioning apparatus 40.

In addition, a micro main board 60 serving as a control center is mounted on the adjustable cushioning apparatus 40 for an effective control and connection among the displacement detector 50, the driving motor 41, the micro-switches 45, 46 and the electronic control panel 22. Regarding the electric connection thereof, it belongs to prior art so that no further descriptions thereto are given hereinafter.

Many changes and modifications in the above-described embodiment of the invention can, of course, be carried out without departing from the scope thereof Accordingly, to promote the progress in science and the useful arts, the invention is disclosed and is intended to be limited only by the scope of the appended claims.

What is claimed is:

1. A treadmill having a base frame, a handgrip frame extending upwardly from both sides at front end of the base frame with an electronic control panel mounted thereon and a deck frame with a running belt movably mounted thereon, comprising:

a) a plurality of cantilevers each having one end pivotably connected to the lower portion of the handgrip frames and the other end pivotably connected to the deck frame;

b) a plurality of adjustable cushioning apparatus each interposed between a connecting arm of the handgrip frame and one of the cantilevers for adjusting the cushioning force in accordance with different forces acting on the deck frame; and c) a plurality of displacement detectors each installed at bottom end of the adjustable cushioning apparatuses.

2. The treadmill of claim 1 wherein the adjustable cushioning apparatus with a driving motor comprising:

a) a motor shaft gear and an adjustment gear so that the driving motor of the adjustable cushioning apparatus brings the adjustment gear in rotation through the motor shaft gear whereby the rotation of the adjustment gear enables the adjustment of the cushioning force provided by the adjustable cushioning apparatus;

b) a coupling control element disposed on the adjustment gear and movable therewith; and c) a plurality of micro-switches for automatically shutting down the driving motor when the control element contacts either of the micro-switches whereby an effective restriction of the adjusting travel caused by the driving motor is attainable.

3. The treadmill of claim 1 wherein the displacement detector comprising:

a) a guide roller;

b) a large gear;

c) a small gear;

d) an optical disk installed at bottom end of the adjustable cushioning apparatus wherein the optical disk and the small gear are received on an identical shaft; and e) a cable with one end fixed at the connecting arm of the handgrip frame extending around the guide roller and the large gear and secured to the other end to the base frame.

* * * * *